US005222998A

United States Patent [19]

Ferrari et al.

[11] Patent Number: 5,222,998

[45] Date of Patent: Jun. 29, 1993

[54] DEVICE FOR FACILITATING APPLICATION OF VARIABLE TENSION TO SPORTS RACQUET STRINGING BED

[75] Inventors: Harry M. Ferrari, Pittsburgh; Raymond P. Harrington, McMurray; Stephen M. Ferlan, Pittsburgh, all of Pa.

[73] Assignee: Ferrari Importing Company, Pittsburgh, Pa.

[21] Appl. No.: 830,028

[22] Filed: Jan. 31, 1992

[51] Int. Cl.[5] ..... A63B 51/14

[52] U.S. Cl. ..... 273/73 A; 273/73 R; 273/73 D; 273/73 E

[58] Field of Search ..... 273/73 R, 73 A, 73 B, 273/73 C, 73 D, 73 E

[56] References Cited

U.S. PATENT DOCUMENTS

| | | | |
|---|---|---|---|
| 1,542,177 | 6/1925 | Rose | 273/73 D |
| 2,268,276 | 12/1941 | Caro et al. | 273/73 B |
| 4,330,132 | 5/1982 | Ferrari . | |
| 4,339,131 | 7/1982 | Balaban | 273/73 |
| 4,340,225 | 7/1982 | Wilson | 273/73 E |
| 4,408,760 | 10/1983 | Ferrari . | |
| 4,909,511 | 3/1990 | DeVille et al. | 273/73 D |
| 4,930,782 | 6/1990 | Sines et al. | 273/73 D |
| 5,026,055 | 6/1991 | Longeat . | |

FOREIGN PATENT DOCUMENTS

| | | | |
|---|---|---|---|
| 2611970 | 9/1977 | Fed. Rep. of Germany | 273/73 D |
| 2928748 | 1/1981 | Fed. Rep. of Germany | 273/73 D |
| 3432422 | 3/1986 | Fed. Rep. of Germany | 273/73 E |
| 2627990 | 9/1989 | France | 273/73 D |
| 2058902 | 4/1981 | United Kingdom | 273/73 D |
| 2071253 | 9/1981 | United Kingdom | 273/73 D |
| 2187392 | 9/1987 | United Kingdom | 273/73 D |

*Primary Examiner*—V. Millin
*Assistant Examiner*—Raleigh W. Chiu
*Attorney, Agent, or Firm*—Michael R. Swartz; John R. Flanagan

[57] ABSTRACT

A device can be provided in different embodiments for holding different tensions in different length string sections of a sports racquet stringing bed. In one embodiment, a strip of material is applied on the periphery of the head portion of the racquet and is compressed under the string portions extending between pairs of adjacent stringing holes. In another embodiment, the tension holding device is a plurality of cylindrical bands of compressible material which fit about the string portions and within the grommets of the racquet. In both embodiments, the material is compressed by the string portion to generate sufficient frictional force therebetween to prevent slippage of the string portion relative thereto and thereby hold the different length string sections under the predetermined amount of differential tension. Several embodiments of a variable tension applying device can be mounted across the head portion of the sports racquet to provide displaced locations on a beam across which the longitudinal string sections extend so as to divert them into substantially equal lengths of string sections. After substantially the same amount of tension is applied to each of the equal length string sections, the string sections are released from the tension applying device and then the string sections assume their original different lengths across the open region of the head portion of the racquet with each string section having a different tension which thereby provides a uniform stiffness to the stringing bed made up by the different length string sections.

16 Claims, 8 Drawing Sheets

DEVICE FOR FACILITATING APPLICATION OF VARIABLE TENSION TO SPORTS RACQUET STRINGING BED

BACKGROUND OF THE INVENTION

1. Field of the Invention

The present invention generally relates to sports racquets and, more particularly, is concerned with devices for applying variable tension to different length string sections of a sports racquet stringing bed and for holding the stringing tension to achieve more uniform stringing stiffness across the ball playing face of the racquet and thereby enhance feel and performance of the racquet.

2 Description of the Prior Art

A conventional sports racquet, such as a tennis racquet, has a frame which includes a head portion, a throat portion and a handle portion formed as an integral structure. Typically, the racquet frame is fabricated of composite-type material composed of high modulus fibers such as graphite fibers or glass fibers in a matrix of an epoxy resin. Alternatively, racquet frames have been fabricated from other materials, such as aluminum, wood and plastics.

The head portion of the racquet frame typically has a generally round, such as circle or oval, configuration and contains outer and inner pluralities of spaced stringing holes extending through outer and inner circumferentially-extending, radially-spaced walls of the round head portion. The head portion also typically mounts a plurality of cylindrical hollow grommets between the walls which are aligned with paired holes of the outer and inner pluralities of holes. A bed of stringing extends in a grid pattern across an open region encompassed by the head portion and through the holes and grommets. The stringing bed is applied under tension across the open region of the head portion to provide a ball striking face of the racquet.

Commonly, the stringing of the racquet is composed of animal gut, synthetic material, or metallic materials. Because of the round configuration of the head portion of the racquet, the bed of stringing installed in the head portion will contain string sections having different lengths. The string sections nearest the longitudinal and transverse axes of the head portion will be the longest, while those nearest the periphery of the head portion will be the shortest.

Heretofore, the normal method by which racquets have been strung is by pulling tension on the string sections at the same tension level. It is apparent that a lower stiffness will be imparted to the longer string sections than to the shorter string sections of the stringing bed, producing a non-uniform stiffness throughout the stringing bed across the longitudinal and transverse axes of the racquet. Such non-uniformity of stringing bed stiffness results in a non-uniform rebound of a ball off the stringing bed when struck at different locations thereon. The effect of such non-uniformity of stiffness is that the area of the stringing bed which has the least stiffness and thus produces the highest degree of power, control and feel is near the center of the stringing bed. However, this area is relatively small in comparison to the overall area of the stringing bed It is therefore desirable to provide a bed of stringing of more uniform stiffness so that the rebound of the ball off the stringing bed of the racquet is more uniform across the entire area of the stringing bed to improve the feel and performance of the ball playing face of the racquet. Techniques have been proposed in the prior art to produce this desired effect. U.S. Pat. Nos. 4,330,132 and 4,408,760 to Ferrari disclose a sports racquet in which individual string sections of different lengths are pulled at different tensions.

However, the technique disclosed in the Ferrari patents for holding and maintaining the differential tensions involves the use of wedges which must be installed into the passages of the grommets of the racquet. This poses a problem if the grommet passage is too small to accept both the wedge and string. Also, pulling different lengths of string sections at different tensions poses another problem. The need to keep changing the tension setting of the stringing machine for each different length of string section can be time-consuming and tedious. Also, the technique is dependent upon whether the operator can be relied upon to not forget to change the tension settings while stringing the racquet.

Consequently, a need still exists for improvement of the techniques for tensioning the racquet stringing bed so as to overcome the problems associated with prior art techniques.

SUMMARY OF THE INVENTION

The present invention provides devices for facilitating the application of variable tension to different length string sections of a sports racquet stringing bed and for holding the tension in the different length string sections. The tension applying and holding devices of the present invention are designed to satisfy the aforementioned needs by achieving a more uniform stringing stiffness across the ball playing face of the sports racquet which enhances feel and performance of the racquet.

Accordingly, the present invention is set forth in a sports racquet including a frame having a head portion encompassing an open region and with circumferentially-extending outer and inner radially-spaced walls, a plurality of aligned pairs of outer and inner spaced stringing holes defined and extending through the outer and inner walls of the head portion, a plurality of hollow grommets extending between the outer and inner walls of the head portion and aligned between the pairs of outer and inner holes, and a bed of stringing under a predetermined amount of tension being strung to the head portion. The stringing bed has adjacent string sections pulled at different levels of stringing tension extending across the open region and string portions with string sections on either end extending through the holes and grommets and about the periphery of the head portion between pairs of adjacent holes.

In one embodiment, the stringing tension holding device of the present invention comprises a strip or strips of material with each strip having means for positioning and/or attaching the strip on the head portion between one of the pairs of adjacent holes. Also, each strip underlies and is compressed by one of the string portions to generate sufficient frictional force therebetween to prevent slippage of the string portion relative to the strip and to prevent slippage of the strip relative to the head portion so as to thereby hold the adjoining string sections under the predetermined amount of differential tension.

More particularly, in most racquets the head portion has a peripheral circumferentially-extending recess. The strip of material is attached to the head portion within the peripheral recess thereof. In one form, several strips are interconnected to one another while, in another form, several strips are separate from one another. The attaching means is an adhesive coating on one side of the strip. In one form, the strip of material is a compressible elastomer material while, in another form, the strip of material is a material which provides means for inserting the string sections therethrough, such as a foam material which is also compressible.

In another embodiment, the stringing tension holding device of the present invention comprises a plurality of cylindrical bands of material disposed in the hollow grommets and/or between the outer and inner holes of each pair thereof. Each band has means thereon for positioning and/or attaching the band in one grommet. Each band encompasses, abuts against and is compressed by one of the string portions to generate sufficient frictional force therebetween to prevent slippage of the string portion relative to the band and slippage of the band relative to the grommet or frame to thereby hold the string sections at the adjoining ends of the string portion under the predetermined amount of differential tension. More particularly, the attaching means is an adhesive coating on an outer side of the band. Also, the band of material can either be a compressible elastomer material or a material having means for inserting the stringing therethrough, such as a foam material.

The present invention is also directed to a device for applying variable tension to a plurality of string sections being strung at different lengths along linear paths between opposite end portions of a generally round head portion of a sports racquet and across an open region defined by the head portion. The variable tension applying device comprises: (a) an elongated member positionable across the open region between opposite side portions of the round head portion of the sports racquet and in transverse relation to the string sections of the stringing bed; and (b) means mounted on the elongated member for defining a plurality of locations for receiving thereacross the plurality of string sections. The locations are disposed along the elongated member in spaced relation to one another and spaced from the opposite ends of the head portion. The locations also are offset from the linear paths of the string sections between the opposite ends of the head portion so that the string sections when strung between the opposite ends of the head portion and received across the offset locations will be deflected from their linear paths and thereby have respective lengths greater than their normal lengths along their linear paths. As a result, if a similar amount of tension is applied to individual string sections while they extend across the offset locations, then when the individual string sections are removed from the offset locations on the elongated member and returned to their linear paths, different amounts of tension will remain in the individual string sections. Given that these string sections extending along their linear paths between opposite ends of a round head portion have different lengths, the resulting different amounts of tension therein which correlate to their different lengths will result in a more uniform degree of stiffness of the string sections.

In one embodiment, the locations-defining means is a surface formed on the elongated member having a stepped profile with the locations being defined as lands provided at different distances offset above the linear paths of the individual string sections. In a modified embodiment, the locations-defining means is a surface formed on the elongated member having an arcuate profile with the locations being defined as slots formed in the arcuate surface at different distances offset above the linear paths of the individual string sections. In another embodiment, the locations-defining means is a plurality of pegs mounted on the elongated member with the locations being defined by surfaces of the pegs disposed at different distances offset laterally from the linear paths of the individual string sections. In yet another embodiment, the locations-defining means is a plurality of pedestals rotatably mounted on the elongated member with the locations being defined by top surfaces of the pedestals disposed at different distances above the linear paths of the individual string sections. The pedestals are rotatably mounted to the elongated member so as to be able to vary the distance of the top surfaces of the pedestals from the linear paths of the string sections if desired.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE PREFERRED EMBODIMENTS

Figure 1:
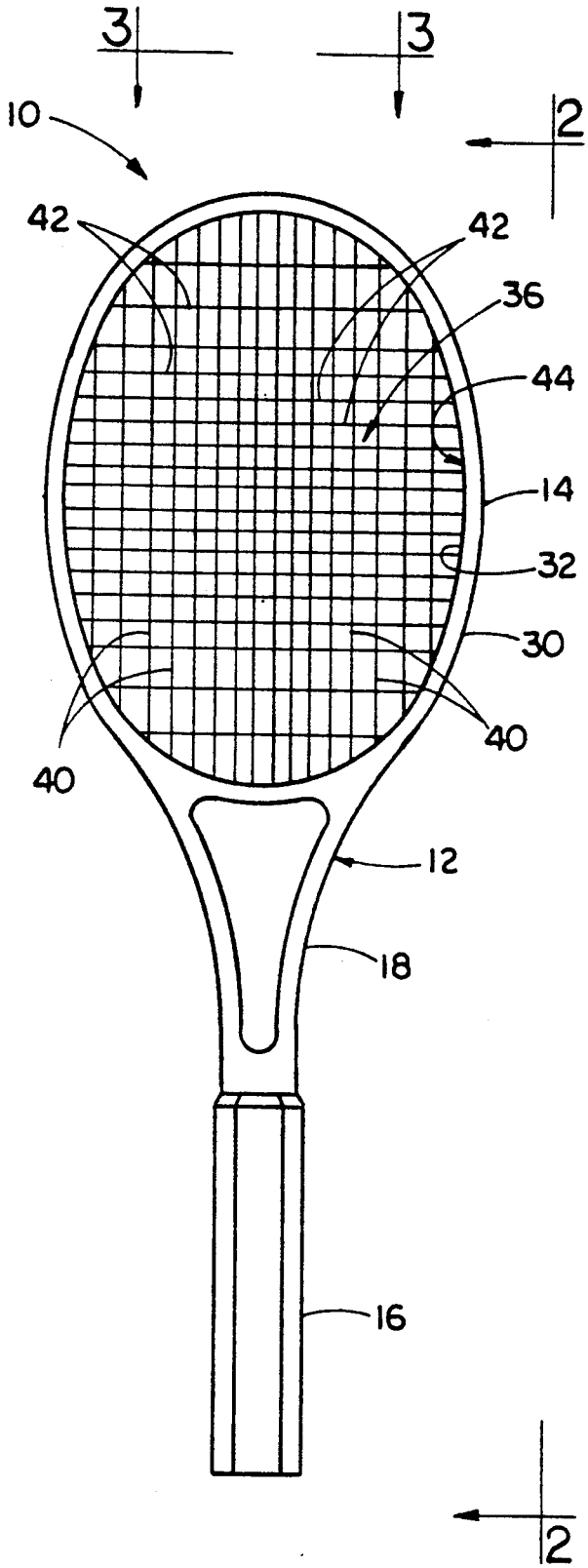
FIG. 1 is a plan view of a prior art tennis racquet having a head portion strung with a bed of stringing containing string sections of different lengths.
Figure 2:
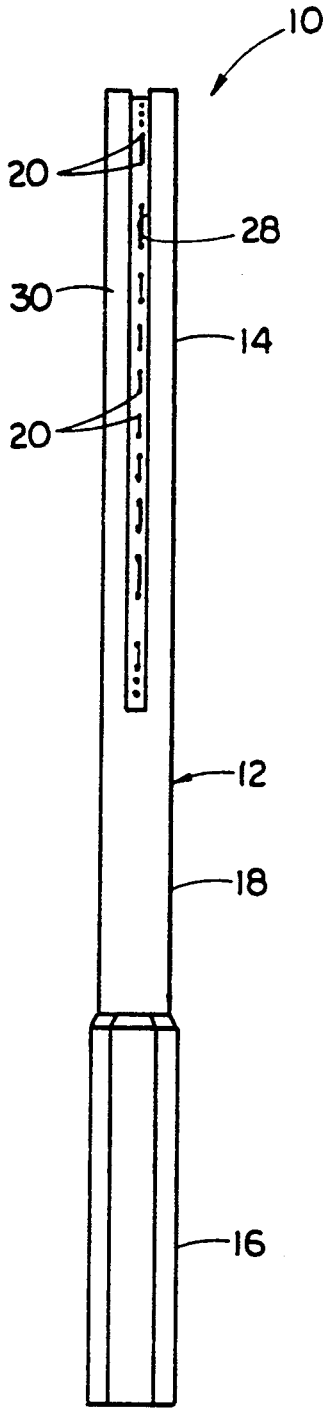
FIG. 2 is a side elevational view of the prior art tennis racquet as seen along line 2—2 of FIG. 1, showing a narrow recess formed in an outer surface of the head portion of the racquet and some of a plurality of outer holes in the recess with stringing extending through and between the holes along the narrow recess.
Figure 3:
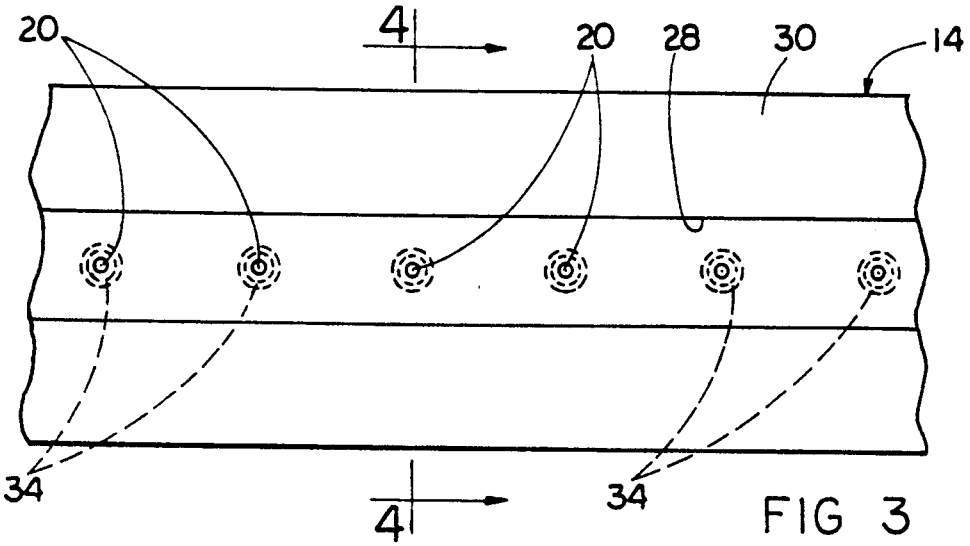
FIG. 3 is an enlarged fragmentary top end view of the prior art tennis racquet as seen along line 3—3 of FIG. 1, showing some of the outer holes in the head portion of the racquet without the stringing being shown.
Figure 5:
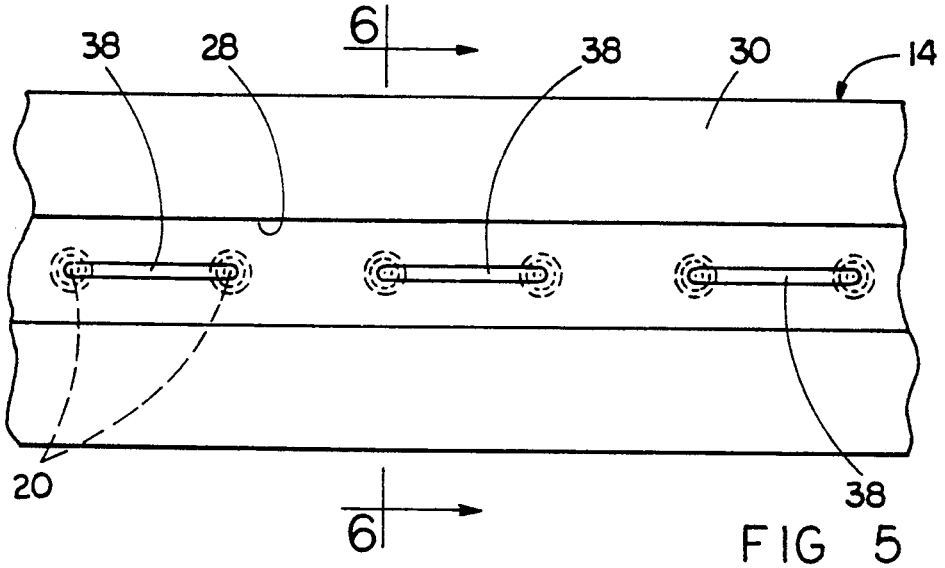
FIG. 5 is an enlarged fragmentary top end view of the prior art tennis racquet similar to that of FIG. 3, but showing stringing extending through and between the outer holes in the head portion of the racquet.
Figure 4:
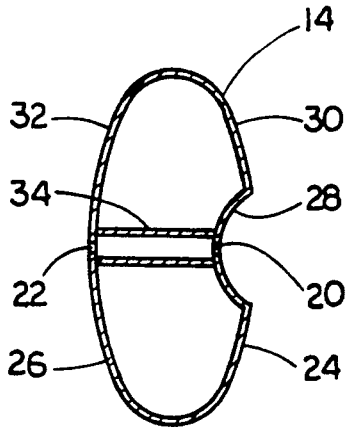
FIG. 4 is a radial sectional view of the prior art tennis racquet taken along line 4—4 of FIG. 3, showing a pair of aligned outer and inner holes in the head portion of the racquet and a hollow grommet aligned with and mounted between the pair of holes.
Figure 6:
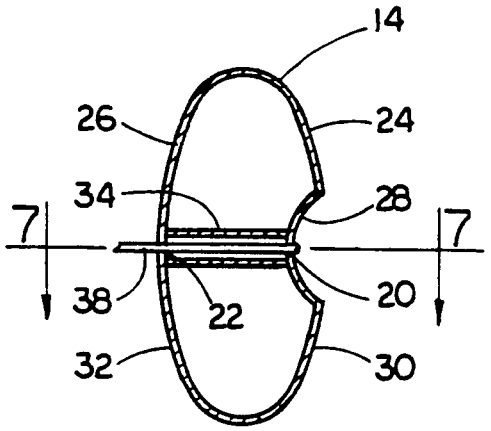
FIG. 6 is a radial sectional view of the prior art tennis racquet taken along line 6—6 of FIG. 5, showing a pair of aligned outer and inner holes in the head portion of the racquet, a hollow grommet aligned with and mounted between the pair of holes, and stringing extending through the pair of holes and the grommet.
Figure 7:
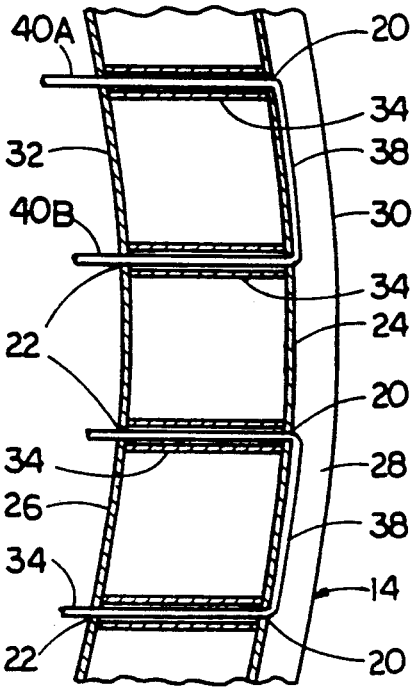
FIG. 7 is a fragmentary circumferential sectional view of the prior art tennis racquet taken along line 7—7 of FIG. 6, showing stringing extending through and between pairs of outer and inner holes and hollow grommets mounted between the pairs of holes.
Figure 8:
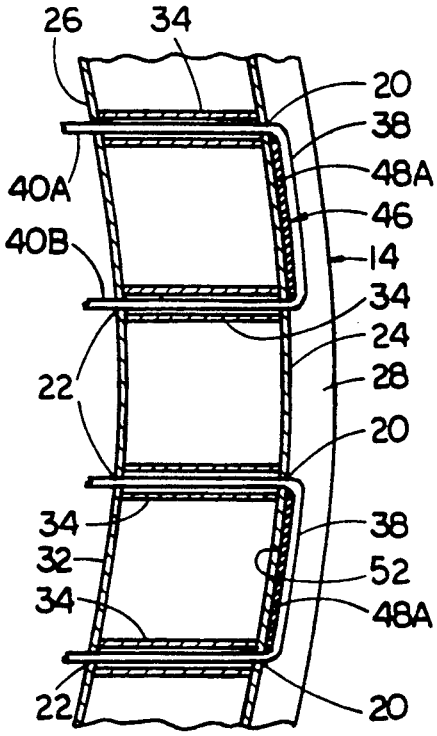
FIG. 8 is a view similar to FIG. 7, but showing a plurality of strips of material attached on the racquet head portion and engaged with portions of the stringing for generating sufficient friction to prevent slipping and reduction of the differential tension between the adjacent string sections in accordance with a first embodiment of a stringing tension holding device of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIGS. 1–7, there is shown a prior art tennis racquet, generally indicated by the numeral 10. While the present invention is illustrated in the drawings and described below with respect to tensioning the stringing of the tennis racquet 10, the present invention can be employed in tensioning the stringing of racquets used in playing other sports comparable to tennis, such as squash, racquetball and badminton. Thus, the reference hereafter to a tennis racquet 10 should be construed in a generic sense as applicable to other sports racquets.

In its basic construction, the tennis racquet 10 has a frame 12 which includes a head portion 14, a handle portion 16, and a throat portion 18 extending between and interconnecting the head and handle portions 14 and 16. The racquet frame 12 typically is fabricated of a composite-type material composed of high modulus fibers such as graphite fibers or glass fibers in a matrix of an epoxy resin. Alternatively, the racquet frame 12 can be fabricated from other materials, such as aluminum, wood and plastics.

The head portion 14 of the racquet frame 12 typically has a generally round, such as circular or oval, configuration and a hollow construction. The hollow interior of the head portion 14 can be filled with filler foam material (not shown) whose purpose is to prevent chips which are produced in the head portion 14 during fabrication from later making noise during use of the tennis racquet 10. Also, the head portion 14 contains outer and inner pluralities of spaced stringing holes 20, 22 extending through outer and inner spaced walls 24, 26 of the head portion 14. The outer plurality of spaced stringing holes 20 are open along a narrow groove or recess 28 formed in an outwardly facing surface 30 of the outer wall 24 of the head portion 14. The inner plurality of spaced stringing holes 22 are open along an inwardly facing surface 32 of the inner wall 26 of the head portion 14. The holes 20 of the outer plurality thereof are aligned and paired with the holes 22 of the inner plurality thereof. Further, all of the stringing holes 20, 22 are typically aligned in a common plane.

The head portion 14 of the racquet 10 also contains a plurality of cylindrical hollow grommets 34 being disposed in the hollow interior thereof. The grommets 34 extend between the outer and inner spaced walls 24, 26 of the head portion 14 and are aligned with and extend between the paired outer and inner holes 20, 22. In a known manner, a bed of stringing 36 is strung to the head portion 14 such that a plurality of string portions 38 of the stringing 36 extend through the outer and inner holes 20, 22 and grommets 34 and about the peripheral recess 28 of the head portion 14 between pairs of adjacent outer holes 20, and a plurality of different length string sections 40, 42 of the stringing 36, being interconnected by the string portions 38, extend longitudinally and transversely in an interwoven grid pattern under a desired predetermined amount of tension across an open region 44 encompassed by the round head portion 14 so as to provide a ball, or other object, striking area of the racquet 10.

Stringing Bed Tension Holding Devices

Referring to FIGS. 8–16, there is illustrated several embodiments of a stringing tension holding device of the present invention, being generally designated by the numeral 46. After the desired predetermined amount of tension has been pulled in the stringing 36, the device 46 will function to hold and maintained the desired tension in the stringing 36.

Referring to FIGS. 8, 9, 11, 14 and 15, a first embodiment of the stringing tension holding device 46 is in the form of a flat tape or strip 48 of material having flat portions 48A applied on the outwardly facing surface 30 of the outer wall 24 within the peripheral recess 28 of the head portion 14 of the racquet 10. Each flat strip portion 48A has means thereon, such as a pressure-sensitive adhesive coating 50 (FIG. 11) on at least one surface 52 of the strip portion 48A for stationarily attaching the flat strip portion 48A on the outwardly facing surface 30 of the head portion 14 between one of the pairs of adjacent outer holes 20. Each flat strip portion 48A underlies and is compressed by one of the string portions 38. The compressible material of each flat strip portion 48 generates sufficient frictional force between it and the string portion 38 to substantially prevent slippage of the string portion 38 relative to it. In such manner, strip 48 of compressible material substantially holds and maintains a differential tension between the string sections 40A, 40B on either end of the string portion 38.

Figure 11:
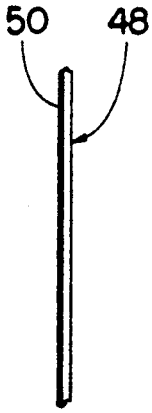
FIG. 11 is a fragmentary top plan view of a continuous strip of friction-generating material of the second embodiment of the stringing tension holding device.
Figure 9:
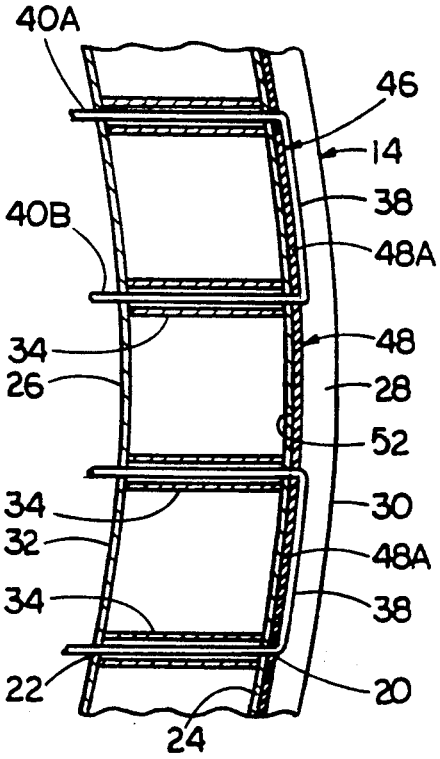
FIG. 9 is a view similar to FIG. 7, but showing a continuous strip of material attached on the racquet head portion and engaged with portions of the stringing for generating sufficient friction to prevent slipping and reduction of the differential tension between the adjacent string sections in accordance with a second embodiment of a stringing tension holding device of the present invention.
Figure 10:
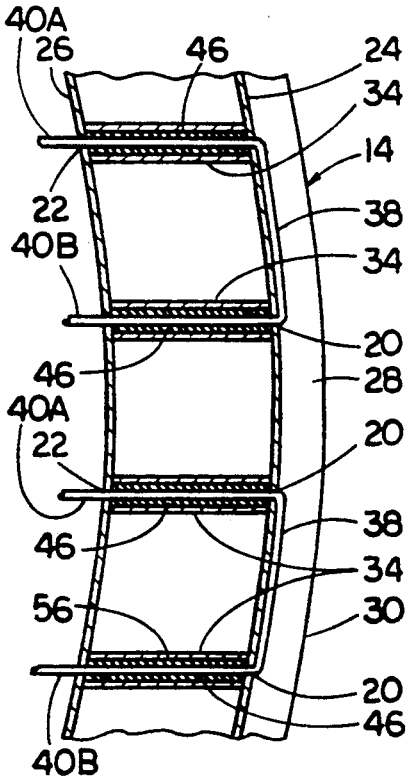
FIG. 10 is a view similar to FIG. 7, but showing a plurality of cylindrical bands of a material disposed in the hollow grommets and engaged about the string portions extending through the pairs of holes in the racquet head portion for generating sufficient friction to prevent slippage and loosening of differential tension between the adjacent string sections in accordance with a third embodiment of a stringing tension holding device of the present invention.
Figure 13:
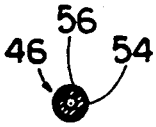
FIG. 13 is a cross-sectional view of the cylindrical band of material taken along line 13—13 of FIG. 12.
Figure 12:
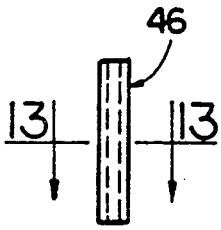
FIG. 12 is an enlarged side elevational view of the cylindrical band of friction-generating material of the third embodiment of the stringing tension holding device.
Figure 14:
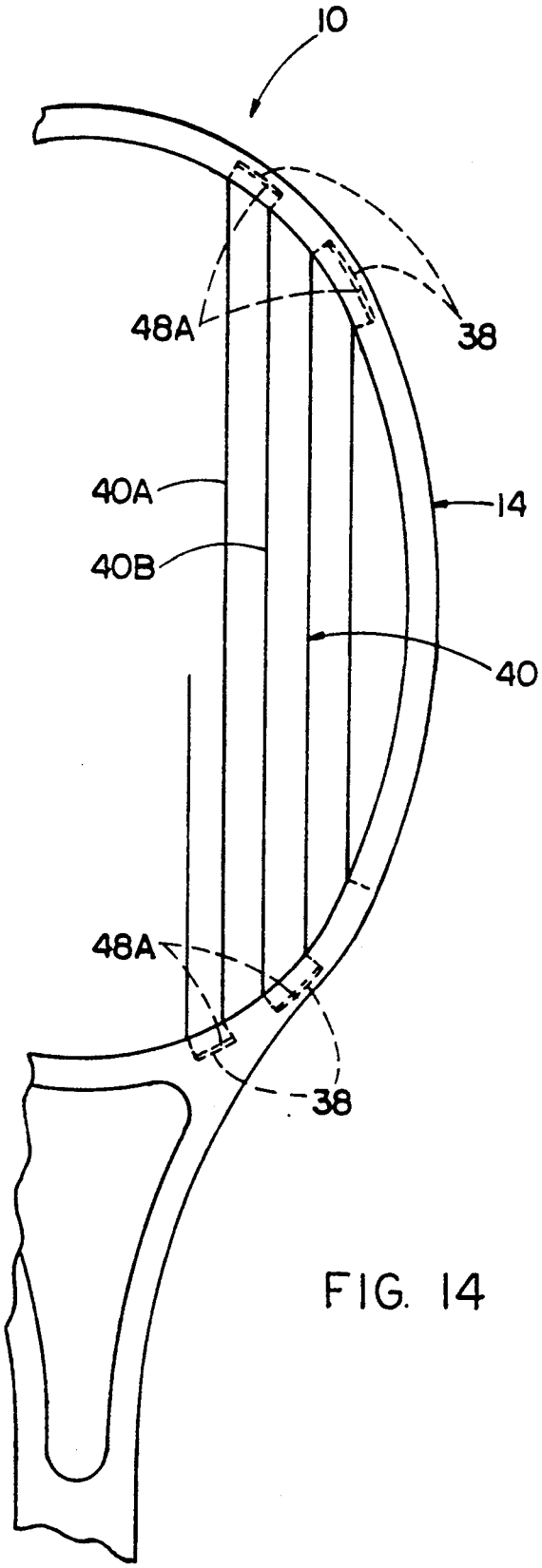
FIG. 14 is a diagrammatic representation of a fragmentary portion of the sports racquet having the first embodiment of the stringing tension holding device of FIG. 8.
Figure 15:
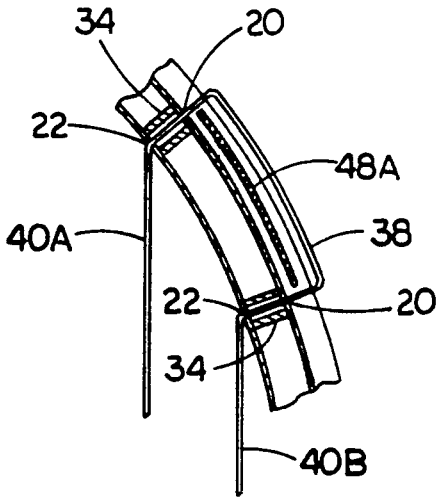
FIG. 15 is a diagrammatic representation of an enlarged portion of the sports racquet of FIG. 14.
Figure 16:
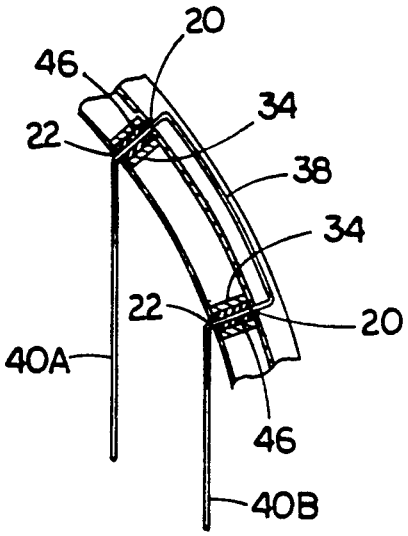
FIG. 16 is a diagrammatic representation of a fragmentary portion of the sports racquet having the third embodiment of the stringing tension holding device of FIG. 10.

In one form of the stringing tension holding strip 48 shown in FIGS. 9 and 11, the flat portions 48A remain interconnected to one another. The material of the strip 48 is tearable or perforated so that the stringing 36 can readily be inserted through the strip 48 upon being applied to the head portion 14 of the racquet 10. In another form of the stringing tension holding strip 48 shown in FIGS. 8, 14, and 15, the flat portions 48A are separate from one another. The material of the strip 48 can be any suitable material, such as a compressible elastomer material or flexible plastic foam material or any other such material which would provide a frictional retaining force to sufficiently hold the string portion 38.

Referring to FIGS. 10, 12, 13 and 16, a second embodiment of the springing tension holding device 46 is a plurality of cylindrical bands 46 of compressible material. The bands 46 can be disposed through the hollow grommets 34 between the outer and inner holes 20, 22 of each pair thereof, or, in instances wherein the racquet does not contain grommets, the bands 46 can be disposed between the outer and inner holes 20, 22 of each pair thereof. The bands 46 fit about the string portions 38 within the hollow grommets 34 of the racquet head portion 14 or within the outer and inner holes 20, 22 of the head portion 14. Each band 46 can have attaching means in the form of a pressure-sensitive adhesive coating 54 on an outer surface 56 thereof for stationarily attaching the band in the one grommet 34. As can be appreciated, there are numerous other means or ways (not shown) for attaching the band 46 to the grommet 34, such as having internal ribs (not shown) on the grommet or having an end cap (not shown) on the inner end of the grommet which the band would abut against so as to attach or retain the band within the grommet. Preferably, each band 46 encompasses and is compressed by one of the string portions 38 to generate sufficient frictional force therebetween to prevent slippage of the string portion 38 relative to the band and thereby hold a predetermined amount of differential tension between the string sections 40A and 40B adjoining either end of the string portion 38. Also, the material of the band 46 can be any suitable material, for example, either a compressible elastomer material or a flexible plastic foam material and the band may only partially encompass or abut against the string portion to obtain the necessary amount of frictional force needed to prevent such slippage.

Variable Tension Applying Devices And Method

Referring to FIGS. 17–24, there is illustrated several embodiments of a variable tension applying device of the present invention, being generally designated by the numeral 56, which during use is mounted across the head portion 14 of the sports racquet 10 between opposite side thereof. As was shown in FIG. 1, the longitudinal string sections 40 of the stringing bed 36 extending across the open region 44 have different lengths along linear paths between opposite upper and lower end portions of the head portion of a sports racquet 10 due to the round configuration of the head portion. Unless each string section 40 is pulled to impart an amount of tension therein correlated with its length, the different length string sections will have different degrees of stiffness. The variable tension applying device 56 is designed to provide a tension in each string section 40 which results in a similar stiffness in all string sections with its particular length.

Each of the embodiments of the stringing tension applying device 56 includes an elongated member in the form of a beam 58 positionable across the open region 44 between opposite sides of the round head portion 14 of the sports racquet 10 and in transverse relation to the longitudinal string sections 40 of the stringing bed 36. Means, generally designated 60, are provided on the elongated beam 58 which define a plurality of locations 62 for receiving thereacross the plurality of longitudinal string sections 40. The locations 62 are disposed along the beam 58 in spaced relation to one another and spaced from the opposite upper and lower ends of the head portion 14. The locations 62 also are offset from the linear paths of the string sections 40, shown in FIG. 1, extending between the opposite upper and lower ends of the head portion 14 through respective distances inversely related to the respective lengths of the string sections 40 relative to one another along their linear paths. In other words, the shorter the string section 40, the longer the distance it must be deflected to be placed over the particular location, whereas the longer the string section 40, the shorter the distance it must be deflected to be placed over the particular location. Thus, when the longitudinal string sections 40 are strung between the opposite upper and lower ends of the head portion 14 and received across the plurality of locations 62, they will be deflected from their linear paths through the respective distances of the offset and thereby have respective lengths greater than their normal lengths along their linear paths. Therefore, if the same amount of tension is applied to individual longitudinal string sections 40 having the same length while they extend across the offset locations 62, then different amounts of tension will result in the individual string sections having different lengths upon their removal from across the offset locations 62 and return to their linear paths. In other words, after substantially the same amount of tension is applied to each of the equal lengths of longitudinal string sections 40 and the string sections 40 are then released from the tension applying device 56, the string sections 40 then assume their original different lengths across the open region 44 of the round head portion 14 of the racquet 10 and at the same time provide a substantially uniform stiffness to the stringing bed 36 made up by the different length longitudinal string sections 40.

Figure 17:
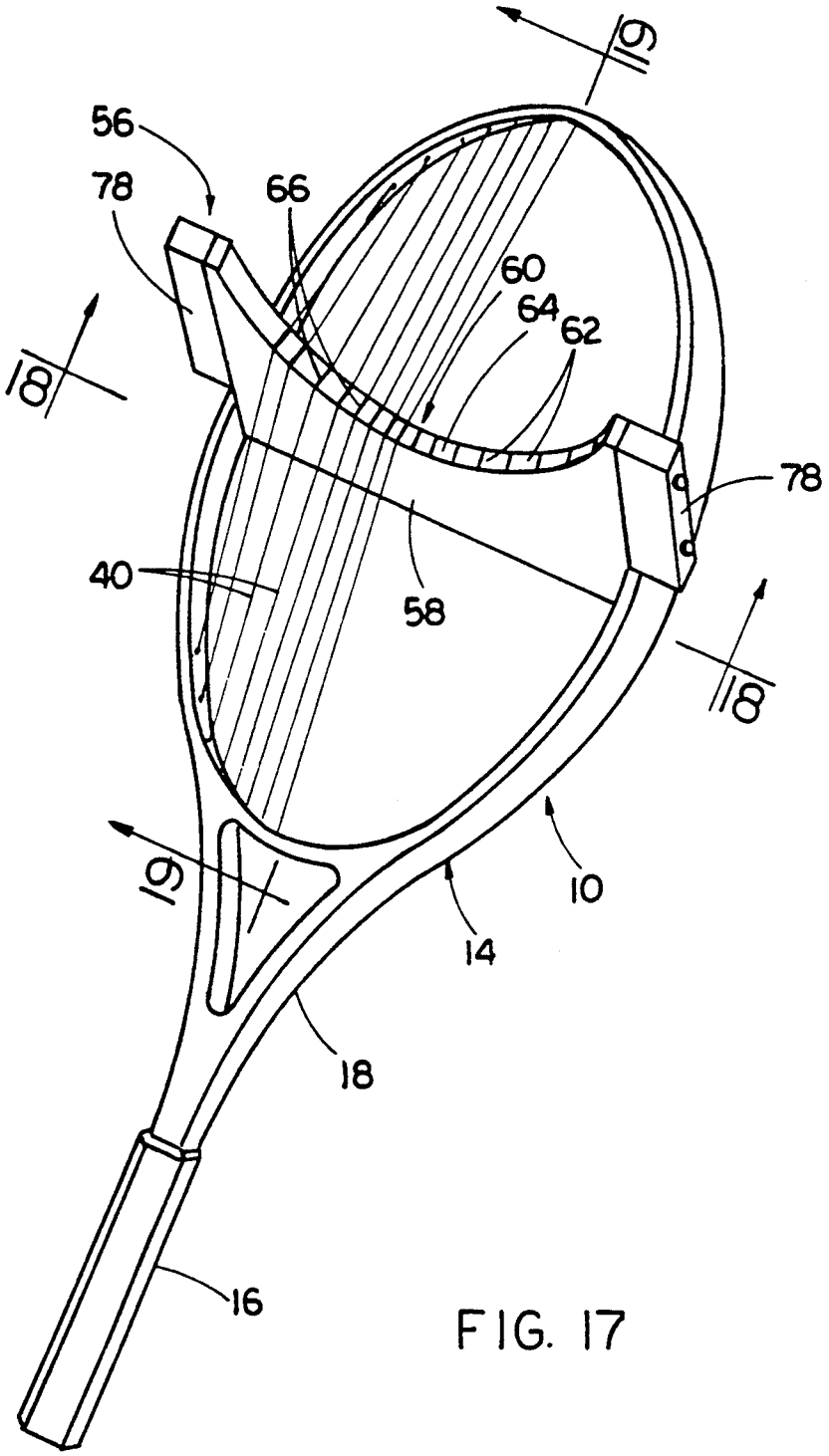
FIG. 17 is a perspective view of a first embodiment of a variable tension applying device of the present invention mounted across the head portion of a sports racquet which provides substantially equal lengths of string sections extending across the device.
Figure 18:
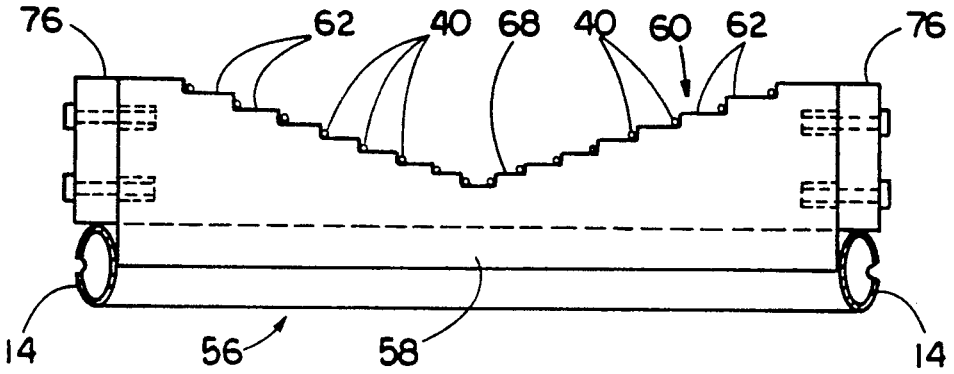
FIG. 18 is an enlarged front elevational view of the first embodiment of the variable tension applying device as seen along line 18—18 of FIG. 17 with the string sections being shown and having a modified profile.
Figure 19:
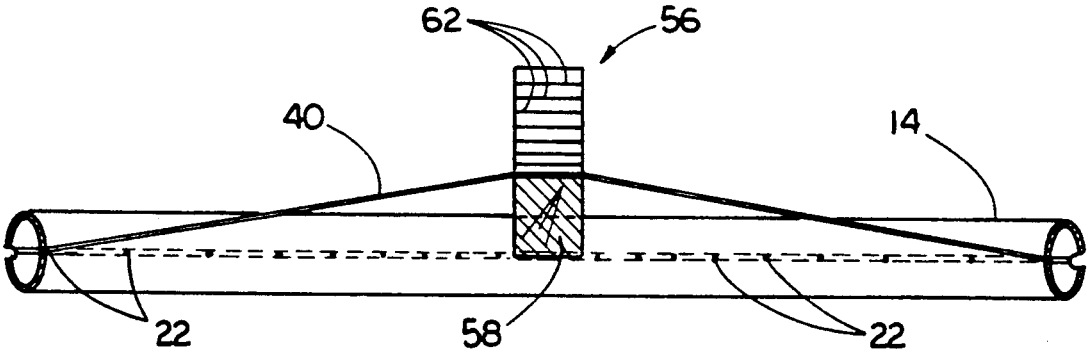
FIG. 19 is an enlarged cross-sectional view of the first embodiment of the variable tension applying device taken along line 19—19 of FIG. 17.

Referring to the one embodiment shown in FIGS. 17 and 19, the locations-defining means 60 is a surface 64 formed on the elongated beam 58 having an arcuate profile with the locations 62 being defined as slots 66 formed in the arcuate surface 64 at different distances offset above the linear paths of the individual string sections 40. In a modified embodiment shown in FIG. 18, the locations-defining means 60 is a surface 68 formed on the elongated beam 58 having a stepped profile with the locations 62 being defined as lands 62 provided at different distances above the linear paths of the individual string sections 40.

Figure 21:
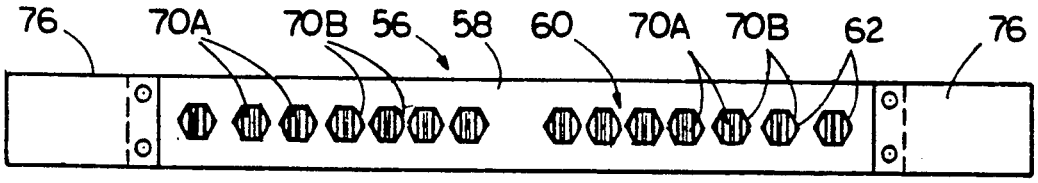
FIG. 21 is a top plan view of the second embodiment of the variable tension applying device as seen along line 21—21 of FIG. 20.
Figure 20:
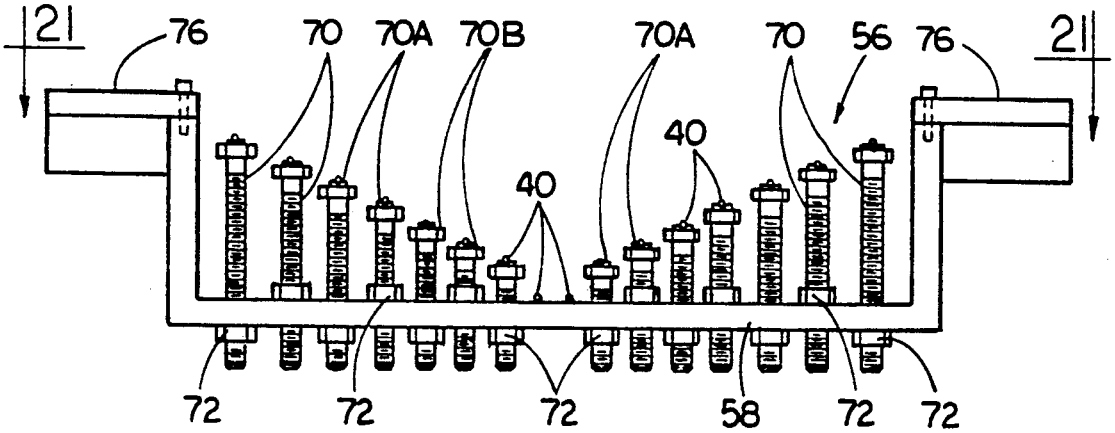
FIG. 20 is a front elevational view of a second embodiment of the variable tension applying device of the present invention.

Referring to another embodiment shown in FIGS. 20 and 21, the locations-defining means 60 is a plurality of pedestals 70 in the form of threaded bolts 70 rotatably mounted on the elongated beam 58 with the locations 62 being defined by the grooved top surfaces 70A on the heads 70B of the bolts 70 being disposed at different distances above the linear paths of the individual string sections 40. The bolts or pedestals 50 are rotatably mounted to the elongated beam 58 member so that by turning the bolts 70 the distance of their top surfaces 70A above the linear paths of the string sections 40 can be varied. Lock nuts 72 are provided on the bolts 70 in alternating positions above and below the beam 58.

Figure 22:
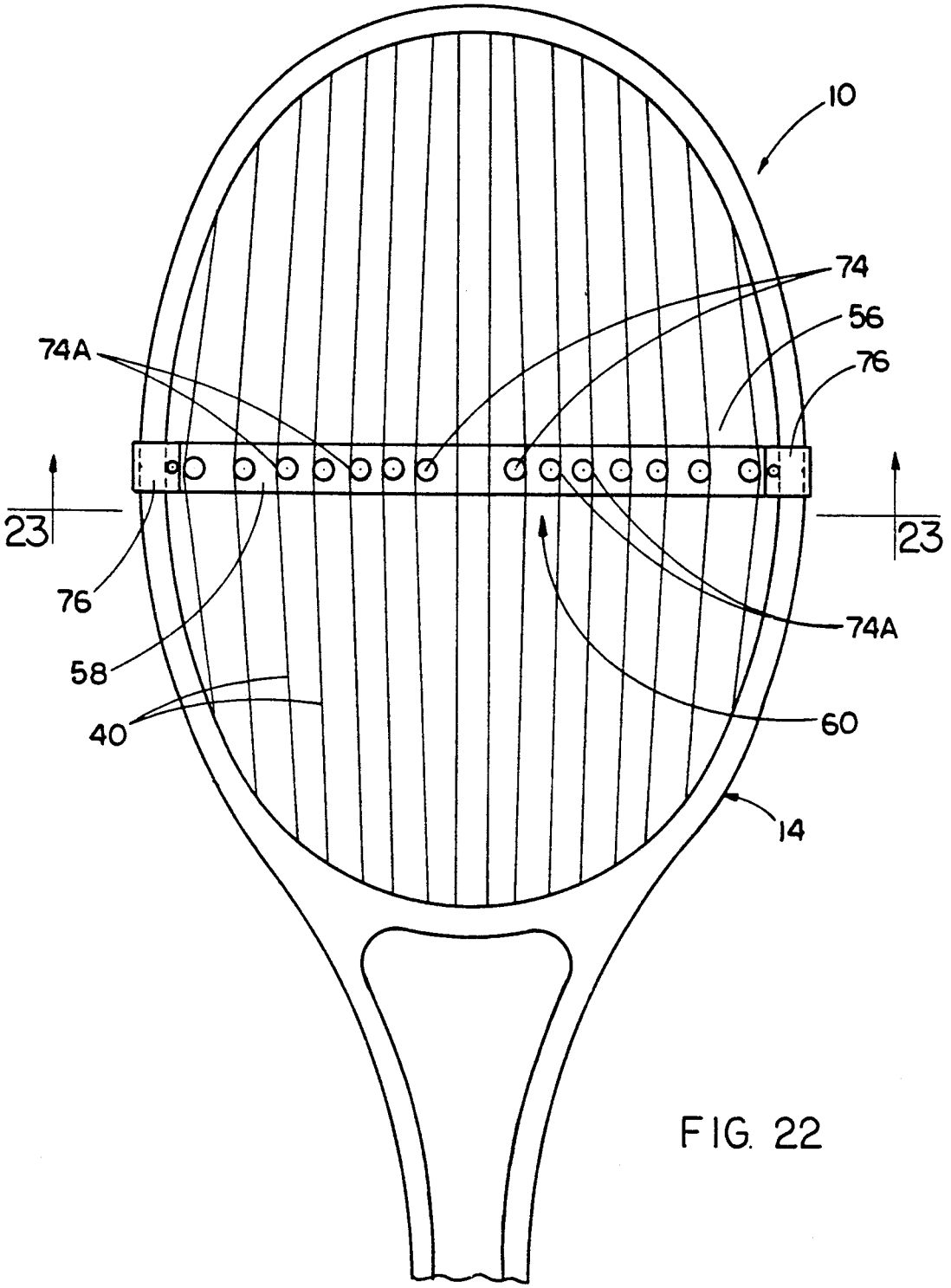
FIG. 22 is a top plan view of a third embodiment of a variable tension applying device of the present invention mounted across the head portion of the sports racquet.
Figure 23:
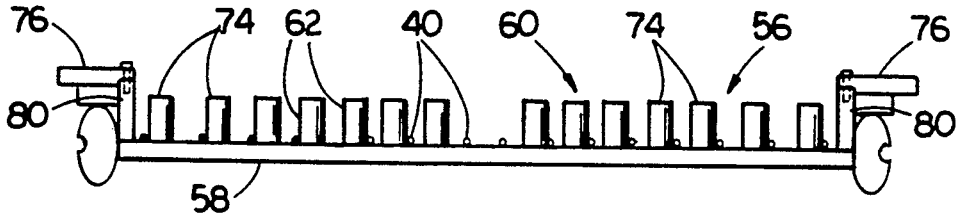
FIG. 23 is a front elevational view of the third embodiment of the variable tension applying device as seen along line 23—23 of FIG. 22 with the sports racquet and string sections being shown.
Figure 24:
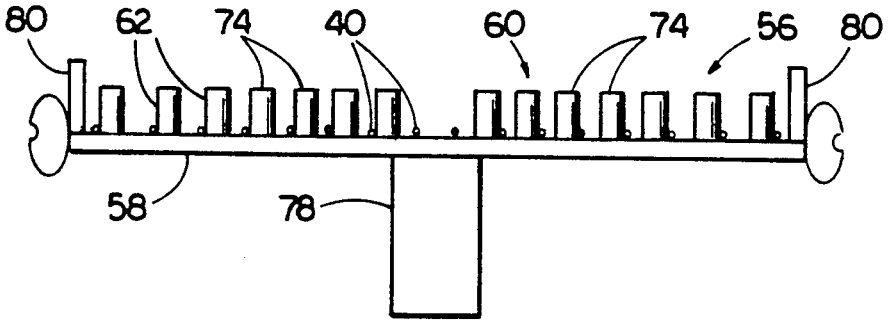
FIG. 24 is a front elevational view of a modified form of the third embodiment of the variable tension applying device shown in FIG. 23.

Referring to another embodiment shown in FIGS. 22–24, the locations-defining means 60 is a plurality of pegs 74 mounted on the elongated beam 58 with the locations 62 being defined by side surfaces 74A on the pegs 74 disposed at different distances laterally offset from the linear paths of the individual string sections 40.

The tension applying device 56 can have wings 76 detachably mounted by fasteners 78 or removably mounted on posts 80 at the opposite ends of the elongated beam 58, such as respectively seen in FIGS. 17–22 and FIG. 23. The wings 76 are disposed in extended positions and rest on the sides of the head portion 14 of the racquet during use of the device 56 when tension is being pulled in the longitudinal string sections 40 by a suitable conventional apparatus, such as disclosed in U.S. Pat. No. 5,026,055 to Longeat. The wings 76 and then removed by unfastening the fastener 78 to remove the device 56 and release the engagement with the longitudinal string sections 38. Alternatively, the beam 58 can be supported by a brace 82 which is independent of the racquet 10, such as mounted to the string pulled apparatus.

It is though that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A device for facilitating application of variable tension to a plurality of string sections of a stringing bed being strung at different lengths along linear paths between opposite ends of a generally round head portion of a sports racquet and across an open region defined by the head portion, said device comprising:

(a) an elongated member positionable across the open region between opposite sides of the round head portion of the sports racquet and in transverse relation to the string sections of the stringing bed; and (b) means on said elongated member for defining a plurality of locations for receiving thereacross the plurality of string sections, said locations being disposed along said member in spaced relation to one another and spaced from the opposite ends of the head portion, said locations also being offset from the linear paths of the string sections through respective distances inversely relative to the respective lengths of the string sections relative to one another along their linear paths so that the string sections when strung between the opposite ends of the head portion and received across said plurality of locations are deflected from their linear paths through said respective distances so as to temporarily have respective lengths greater than their lengths along their linear paths such that when a similar amount of tension is applied thereafter to individual string sections while they extend across said offset locations different amounts of tension will be imposed in the individual string sections upon their removal from across said offset locations and return to their linear paths.

2. The device as recited in claim 1, wherein said locations-defining means is a surface on said elongated member having a stepped profile with said locations being defined as lands provided at different distances above the linear paths of the individual string sections.

3. The device as recited in claim 1, wherein said locations-defining means is a surface on said elongated member having an arcuate profile with said locations being defined as slots being formed in said arcuate surface at different distances above the linear paths of the individual string sections.

4. The device as recited in claim 1, wherein said locations-defining means is a plurality of pegs mounted on said elongated member with said locations being defined by surfaces of said pegs being disposed at different distances laterally from the linear paths of the individual string sections.

5. The device as recited in claim 1, wherein said locations-defining means is a plurality of pedestals adjustably mounted on said elongated member with said locations being defined by top surfaces on said pedestals being disposed at different distances above the linear paths of the individual string sections.

6. The device as recited in claim 5, wherein said pedestals are rotatably mounted to said elongated member so as to vary the distance of said top surfaces of said pedestals above the linear paths of the string sections.

7. The device as recited in claim 6, wherein said locations-defining means also includes a plurality of lock elements rotatably mounted to said pedestals and being adjustable for locking said pedestals in a stationary position relative to said elongated member.

8. The device as recited in claim 1, further comprising:

a pair of elements movably mounted to opposite ends of said elongated member and being disposable in first positions in which said elements rest upon said opposite sides of the head portion of the racquet during use of said device when tension is being pulled in said string sections, said elements being movable away from said opposite sides of the head portion to permit removal of said device and release its engagement with said string sections.

9. The device as recited in claim 1, further comprising:

a support member disposed below said elongated member and supporting said elongated member for movement toward and away from the open region of the racquet head portion to respectively engage and release the string sections.

10. A method for facilitating application of variable tension to a plurality of string sections of a stringing bed being strung at different lengths along linear paths between opposite ends of a generally round head portion of a sports racquet and across an open region defined by the head portion, said method comprising the steps of:

(a) positioning an elongated member across the open region between opposite sides of the round head portion of the sports racquet and in transverse relation to the string sections of the stringing bed, the elongated member having predetermined locations defined thereon in spaced relation to one another and spaced from the opposite ends of the head portion and being offset from the linear paths of the string sections through respective distances inversely related to the respective lengths of the string sections relative to one another along their linear paths; and (b) deflecting the string sections of the stringing bed from their linear paths through said respective distances over the offset locations on the elongated member so as to temporarily provide the string sections with respective lengths greater than their lengths along their linear paths such that when a similar amount of tension is applied thereafter to individual string sections while they extend across said offset locations different amounts of tension will be imposed in the individual string sections upon their removal from across said offset locations and return to their linear paths.

11. The method as recited in claim 10, further comprising the step of:

defining the locations by providing lands in a stepped profile on a surface on the elongated member such that the lands are disposed at different distances above the linear paths of the individual string sections.

12. The method as recited in claim 10, further comprising the step of:

defining the locations by providing slots in a surface having an arcuate profile on the elongated member such that the slots are disposed at different distances above the linear paths of the individual sections.

13. The method as recited in claim 10, further comprising the step of:

defining the locations by mounting a plurality of pegs on the elongated member such that the surfaces on the pegs are disposed at different distances laterally from the linear paths of the individual string sections.

14. The method as recited in claim 10, further comprising the step of:

defining the locations by adjustably mounting a plurality of pedestals on the elongated member such that top surfaces on the pedestals are disposed at different distances above the linear paths of the individual string sections.

15. The method as recited in claim 14, further comprising the step of:

rotating the pedestals relative to the elongated member so as to vary the distance of the top surfaces of the pedestals above the linear paths of the string sections.

16. The method as recited in claim 15, further comprising the step of:

locking the pedestals in a stationary position relative to the elongated member.

* * * * *